US009809922B2

(12) United States Patent
Salomonsson

(10) Patent No.: US 9,809,922 B2
(45) Date of Patent: Nov. 7, 2017

(54) RECEPTACLE FOR SUPPLY OF A TREATMENT AGENT

(71) Applicant: ELECTROLUX LAUNDRY SYSTEMS SWEDEN AB, Ljungby (SE)

(72) Inventor: Magnus Salomonsson, Banglamung (TH)

(73) Assignee: Electrolux Laundry Systems Sweden AB, Ljungby (SE)

( * ) Notice: Subject to any disclaimer, the term of this patent is extended or adjusted under 35 U.S.C. 154(b) by 0 days.

(21) Appl. No.: 14/424,816

(22) PCT Filed: Mar. 4, 2013

(86) PCT No.: PCT/EP2013/054242
§ 371 (c)(1),
(2) Date: Feb. 27, 2015

(87) PCT Pub. No.: WO2014/037123
PCT Pub. Date: Mar. 13, 2014

(65) Prior Publication Data

US 2015/0259846 A1 Sep. 17, 2015

(30) Foreign Application Priority Data

Sep. 10, 2012 (SE) ..... 1200547

(51) Int. Cl.
*D06F 39/02* (2006.01)
*A47L 15/44* (2006.01)

(52) U.S. Cl.
CPC ..... *D06F 39/028* (2013.01); *A47L 15/4418* (2013.01); *D06F 39/02* (2013.01); *Y10T 137/0329* (2015.04); *Y10T 137/87652* (2015.04)

(58) Field of Classification Search
CPC .... D06F 39/02; D06F 39/028; A47L 15/4418; Y10T 137/87652; Y10T 137/0329
See application file for complete search history.

(56) References Cited

U.S. PATENT DOCUMENTS 883,605 A * 3/1908 Abbott ..... F04C 2/3441 418/255
2,573,787 A * 11/1951 De Ganahl ..... A47L 15/4418 134/200

(Continued)

OTHER PUBLICATIONS

International Search Report for PCT/EP2013/054242, dated May 7, 2013, 2 pages.

*Primary Examiner* — Michael Barr
*Assistant Examiner* — Benjamin L Osterhout
(74) *Attorney, Agent, or Firm* — Pearne & Gordon LLP

(57) ABSTRACT

The present invention relates to a receptacle (20) for supply of a treatment agent to a machine (21) for washing, dishing and rinsing goods. The receptacle comprises at least a first inlet (22*a*) for receiving the treatment agent and at least a second inlet (23) for receiving a liquid. The receptacle further comprises a vessel (24) located at a bottom section of the receptacle, which vessel is arranged to receive the treatment agent and the liquid supplied to the receptacle. Moreover, the receptacle comprises at least a first outlet (25) for supplying the machine with a mixture of the treatment agent and the liquid, said first outlet being in fluid connection with the vessel such that the mixture overflows into the first outlet when the vessel is filled.

20 Claims, 5 Drawing Sheets

(56) References Cited

U.S. PATENT DOCUMENTS 2,643,537 A 6/1953 Woodson
2,654,377 A * 10/1953 Sway ..... A47L 15/06 134/182
2,676,598 A * 4/1954 Bowersox ..... A47L 17/02 134/200
2,812,881 A * 11/1957 Karig ..... A47L 15/4409 134/93
2,919,073 A * 12/1959 Akselrad ..... A47J 43/121 138/40
2,974,832 A * 3/1961 Brucken ..... A47L 15/4418 222/173
3,517,862 A * 6/1970 Bianco ..... A47L 15/4418 222/440
4,503,575 A 3/1985 Knoop et al.
4,932,227 A * 6/1990 Hogrefe ..... D06F 39/022 134/57 D
4,981,024 A * 1/1991 Beldham ..... D06F 39/022 194/243
5,072,473 A * 12/1991 Thuruta ..... D06F 33/02 68/12.05
5,176,297 A * 1/1993 Mooney ..... A47L 15/4445 222/325
5,390,385 A * 2/1995 Beldham ..... D06F 39/022 68/12.18
5,392,618 A * 2/1995 Livingston ..... B01F 15/0454 137/266
5,435,157 A * 7/1995 Laughlin ..... D06F 39/022 137/889
5,453,131 A * 9/1995 Chan ..... A47L 15/4418 134/18
5,758,521 A * 6/1998 Roberts ..... D06F 39/022 222/651
5,870,906 A * 2/1999 Denisar ..... D06F 39/022 134/93
6,035,472 A * 3/2000 Barbe ..... D06F 39/022 68/17 R
6,349,440 B1 2/2002 Amberg et al.
6,662,600 B1 * 12/2003 Field ..... D06F 39/02 134/102.1
7,036,175 B2 * 5/2006 Sears ..... D06F 39/022 68/12.18
8,931,310 B2 * 1/2015 Risen ..... D06F 39/02 68/12.18
2005/0072195 A1 * 4/2005 McEachern ..... D06F 39/022 68/12.01
2006/0117811 A1 * 6/2006 Kinnetz ..... D06F 39/022 68/17 R
2006/0272360 A1 * 12/2006 Hsu ..... A47L 15/4427 68/19
2007/0044820 A1 * 3/2007 Chan ..... A47L 15/4418 134/18

* cited by examiner

RECEPTACLE FOR SUPPLY OF A TREATMENT AGENT

TECHNICAL FIELD

The invention relates to a receptacle for supply of a treatment agent to a machine for washing and/or dishing and/or rinsing goods.

BACKGROUND

In the art, there are problems involved in automatically supplying washing machines with a treatment agent in the form of e.g. liquid detergent or bleach where the detergent is flushed down directly into an inlet hose of the washing machine. A main concern is that aggressive chemicals will act on the rubber inlet hose thus causing corrosion. Corroded hoses will cause significant damages to vital internal parts of the washing machines such as e.g. motors and sensors. This problem is particularly evident in professionally used washing machines, where chemicals utilized generally have a tendency of being more powerful than those included in off-the-shelf detergent used in home appliances.

A solution to this problem has been to connect water supply of the washing machine directly to a detergent chamber located at and accessible via a top aperture on the washing machine. Hence, as is shown in FIG. 1, a water supply hose assembly (not shown) for supplying a washing machine 10 with water are attached to nozzles 11 of an aperture 12 of a detergent chamber 13. The water supplied via the nozzles 11 will thus flush the detergent chamber and dilute potentially aggressive chemicals before they travel from the detergent chamber via the previously mentioned rubber inlet hose and further into the washing machine.

A problem with this solution is that the water supply hose assembly attached to the nozzles 11 of the washing machine 10 must be removed every time the washing machine is to be serviced, which in addition to being time-consuming and tedious further exposes an operator to potentially injurious chemicals located in or in connection to the detergent chamber. Further, having the detergent chamber arranged as in FIG. 1 makes the chamber easily accessible to non-qualified personnel.

SUMMARY

An object of the present invention is to solve or at least mitigate a problem of how to supply a treatment agent to a washing/dishing/rinsing machine without having chemicals comprised in the treatment agent damaging the washing appliance.

This object is attained in a first aspect of the present invention by a receptacle for supply of a treatment agent to a machine for washing and/or dishing and/or rinsing goods. The receptacle comprises at least a first inlet for receiving the treatment agent and at least a second inlet for receiving a liquid. The receptacle further comprises a vessel located at a bottom section of the receptacle, which vessel is arranged to receive the treatment agent and the liquid supplied to the receptacle. Moreover, the receptacle comprises at least a first outlet for supplying the machine with a mixture of the treatment agent and the liquid, said first outlet being in fluid connection with the vessel such that the mixture overflows into the first outlet when the vessel is filled.

Thus, liquid in the form of for example water is supplied to the receptacle via one inlet while a treatment agent, such as e.g. detergent, bleach, softener, starch, etc., is supplied via another inlet. The water and the treatment agent (being embodied as e.g. liquid or gel) will thus flush into the receptacle and travel in a downward direction to a vessel arranged at a bottom section of the receptacle, where the treatment agent will be appropriately diluted by the supplied water. As the treatment agent and water is collected in the vessel, the vessel will eventually fill up, wherein the liquid mixture of treatment agent and water will overflow into an outlet and travel via the outlet further into the washing machine, typically via a rubber hose. Advantageously, when the treatment agent is supplied to the receptacle via the first inlet while the water is supplied to the receptacle via the second inlet, the treatment agent and the water will travel in a downward direction in the receptacle and flush into the vessel with the result that the water will dilute the treatment agent.

When the vessel is full, the mixture of treatment agent and water will overflow into the outlet of the receptacle for further provision to the washing machine. Thus, the treatment agent will not reach the outlet without first having been diluted by the water in the vessel. Consequently, potentially aggressive chemicals comprised in the treatment agent will not act on a rubber inlet hose connected to the outlet of the receptacle. Corroded hoses causing damages to vital internal parts of the machine, being e.g. a washing machine or a dish washer, can hence be avoided. The receptacle is further preferably of a chemical-resistant material such as e.g. polypropylene. The present invention is further advantageous with respect to prior art washing machines, which have been known to discharge small quantities of treatment agent into the washing machine even if a washing programme has been completed, in that any substance discharged into the washing machine after a washing programme has been completed would come in diluted form, i.e. as a mixture of treatment agent and water.

In an embodiment of the present invention, the first inlet for supplying a treatment agent to the receptacle further comprises a plurality of inlets for supplying treatment agents. Thus, different types of treatment agents can be supplied via a respective one of the plurality of inlets. For instance, detergent is supplied via one of the inlets, bleach is supplied via another one of the inlets, while softener is supplied via a third one of the inlets and starch is supplied via a fourth. This is particularly advantageous for professional washing machines. It should be noted that an operator of the washing manually can supply the one or more treatment agents to the receptacle, but alternatively automatic supply of treatment agents can be provided if dosage means are connected to the inlets for supplying treatment agents to the receptacle.

In another embodiment of the present invention, the plurality of inlets for supplying treatment agent to the receptacle are arranged such that an inlet supplying bleach to the receptacle is located closest to the vessel, such that a distance from the inlet supplying bleach to the vessel is minimized. This arrangement reduces the potential risk of having bleach reach the receptacle outlet before having been diluted by liquid, such as water, in the vessel. In this context, it should be noted that bleach typically is the most aggressive treatment agent supplied to a washing machine. Preferably, a visual indicator indicating the treatment agent inlet being located closest to the vessel is provided on the receptacle; the text "bleach" could e.g. be printed on the receptacle in connection to this particular inlet.

In yet another embodiment of the present invention, the inlet for supplying water to the receptacle is arranged at a top section of the receptacle, which is advantageous since the water supplied will flush over the inlet(s) via which the receptacle receives treatment agent(s), thus expediting the transport of the treatment agent(s) downwards in the receptacle for collection in the vessel.

In a further embodiment of the present invention, the receptacle is arranged to be removably mountable to the machine. The receptacle can thus easily be removed from the machine for cleaning, or could swiftly be replaced by a new receptacle if necessary.

In yet a further embodiment of the present invention, the inlet via which water is supplied to the receptacle, and the outlet via which diluted treatment agent is supplied from the receptacle to the machine, are arranged to engage with a water supply and a treatment agent inlet for the washing machine, respectively, for retaining the receptacle in mounted engagement with the machine. Thus, by designing the receptacle such that dimensions of its water inlet and treatment agent are precisely adapted to those of the water supply outlet and treatment agent inlet of the machine, respectively, no further means is necessary for fastening the receptacle to the appliance. A snap-in function is thus advantageously provided for swift receptacle attachment to, and detachment from, the machine.

In still a further embodiment of the present invention, the receptacle is arranged to be removably mountable to a rear side of the machine. In case of mounting the receptacle to a washing machine, this is advantageous since not only is the problem of having potentially aggressive chemicals acting on vital parts of the washing machines, but further the problem previously mentioned of attaching a water supply hose assembly to the top section of the washing machine. With the solution provided by this particular embodiment, servicing of the washing machine can be undertaken without having to disconnecting the water supply assembly of the washing machine. Further advantageous is that the receptacle is not as easily accessible for unauthorized personnel.

The object is further attained in a second aspect of the present invention by a method of supplying the receptacle according to the first aspect of the present invention with treatment agent and liquid. The method comprises the steps of supplying the at least a second inlet with the liquid and supplying the at least a first inlet with the treatment agent while the liquid is supplied via the at least a second inlet, wherein the liquid is supplied via the at least a second inlet for a time period after the supply of the treatment agent via the at least a first inlet has finished such that amount of treatment agent in the mixture in the vessel is below a certain threshold value. Advantageously, by supplying liquid such as water to the receptacle for a time period after the supply of treatment agent has ceased, the mixture in the vessel of the receptacle will be diluted in that the amount of treatment agent in the mixture will be reduced to a certain value (which generally may be determined depending on the particular application). The time period could be selected such that the vessel comprises practically no treatment agent at all.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. In the following, a washing machine is exemplified as being the machine onto which the receptacle is removably mounted. However, the receptacle could alternatively be mounted to another type of machine used for dishing, washing and rinsing goods, such as a dish washer.

Figure 1:
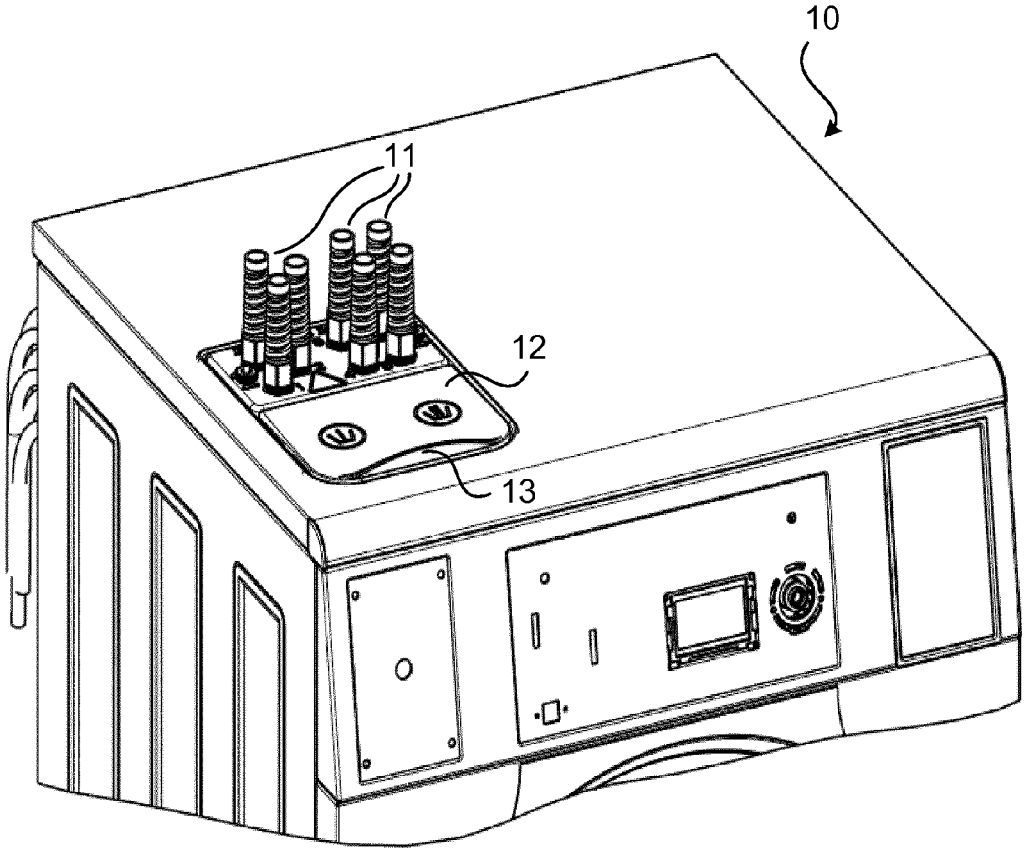
FIG. 1 shows a prior art arrangement for supplying a washing machine with water.

FIG. 1 shows a prior art arrangement as previously discussed with a water hose assembly (now shown) for supplying a washing machine 10 with water are attached to nozzles 11 of an aperture 12 of a detergent chamber 13. The water supplied via the nozzles 11 will thus flush the detergent chamber and dilute potentially aggressive chemicals before they travel from the detergent chamber via the previously mentioned rubber inlet hose and further into the washing machine.

Figure 2:
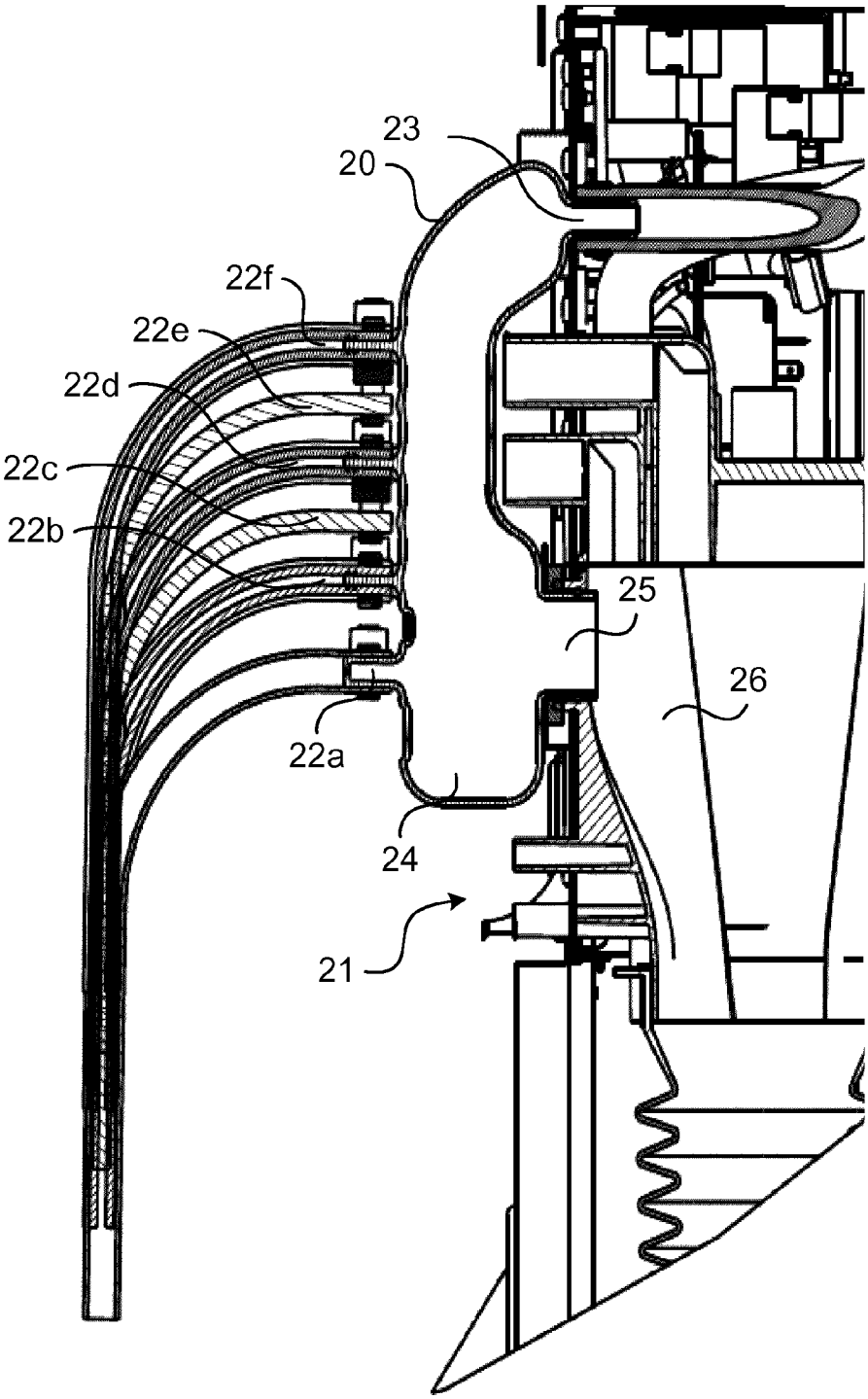
FIG. 2 shows a cross-section view illustrating a receptacle according to an embodiment of the present invention.

FIG. 2 shows a cross-section view illustrating a receptacle 20 according to an embodiment of the present invention for supply of a treatment agent to a machine for washing and rinsing goods in the form of a washing machine 21. The receptacle 20 comprises at least a first inlet 22*a* for receiving a treatment agent such as detergent for washing clothes in the washing machine 21. Preferably, the receptacle 20 comprises a plurality of inlets 22*a-f* via which treatment agents can be supplied to the receptacle (and subsequently to the washing machine 21). Further, the receptacle 20 comprises a second inlet 23 for receiving a liquid, typically in the form of water, from the washing machine 21, via a water supply 28 emanating from the interior side of the washing machine. In this particular exemplifying embodiment, the receptacle 20 comprises a single inlet 23 for receiving water. However, a plurality of inlet for receiving water can be envisaged. Thus, water will flow via the inlet 23 and detergent will be supplied via inlet 22*a* and flush into the elongated receptacle 20 and travel downwards to a bottom section of the receptacle, where a vessel 24 is arranged for collecting the detergent and water supplied to the receptacle. In the vessel 24, the detergent will be diluted by the supplied water, thus resulting in a mixture of detergent and water. As the treatment agent and water is collected in the vessel 24, the vessel will eventually fill up, wherein the liquid mixture of detergent and water will overflow into an outlet 25 for supplying the washing machine 21 with the mixture and travel via the outlet 25 further into the washing machine, typically via a rubber hose 26. Thus, with the dilution caused by using the vessel 24, the proportion of aggressive chemicals comprised in the mixture of detergent and water overflowing into the outlet 25 is decreased to such an extent that the rubber hose 26 is not corroded.

Figure 3:
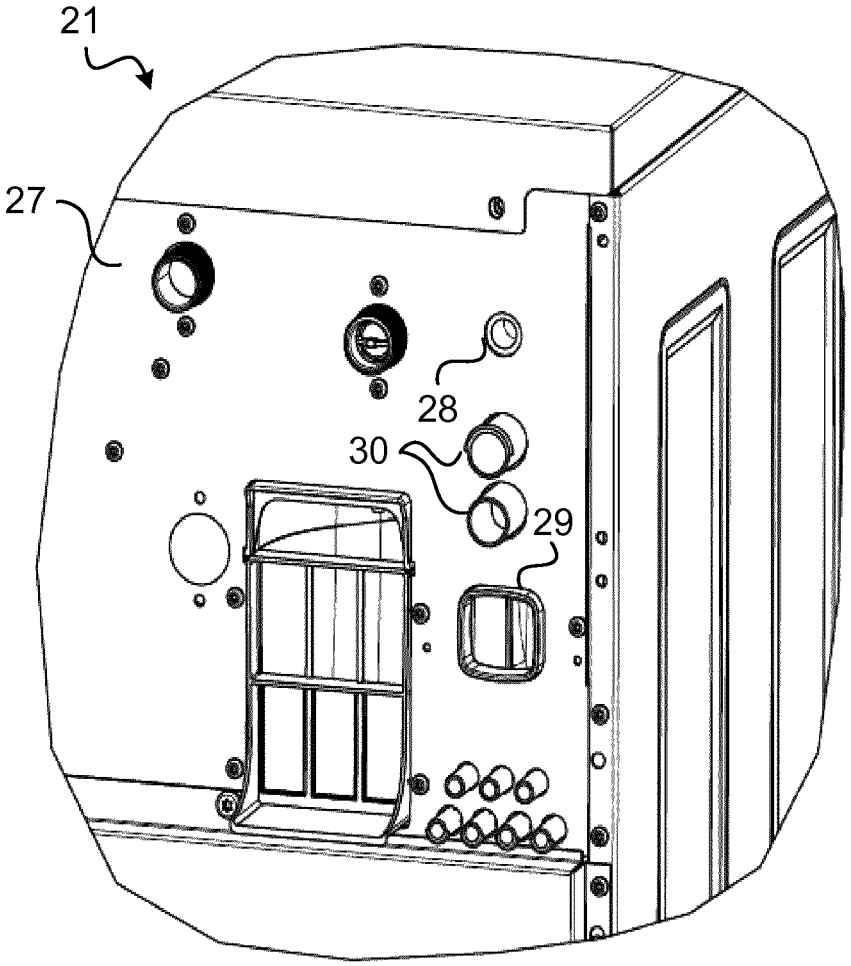
FIG. 3 shows a rear side of a washing machine where a receptacle according to embodiments of the present invention is to be removably mounted.

FIG. 3 shows a rear side 27 of a washing machine 21 where a receptacle (not shown in FIG. 3) according to embodiments of the present invention is to be removably mounted. By mounting the receptacle to the rear side 27 of the washing machine, not only is the application of potentially aggressive chemicals acting detrimentally on vital parts of the washing machines is avoided, but further the problem previously mentioned of having to attach a water supply hose assembly to a detergent chamber at the top section of the washing machine is solved. With the solution provided by this particular embodiment, servicing of the washing machine can be undertaken without having to disconnect the water supply assembly of the washing machine. Further advantageous is that the receptacle is not as easily accessible for unauthorized personnel. Thus, the rear side 27 of the washing machine 21 comprises a water supply 28 via which water is supplied from the interior side of the washing machine. Further, the washing machine 21 comprises a treatment agent inlet 29 for transporting water-diluted treatment agent into the machine. The particular washing machine illustrated in FIG. 3 further comprises ducts 30 for water recovery. The water recovery ducts 30 are however outside the scope of the present invention. The receptacle may be mounted to the washing machine by means of previously discussed snap-in functionality, or alternatively by means of fastening means such as e.g. screws for securing the receptacle firmly to the washing machine 21 for example for security reasons. A tight fit between the receptacle and the washing machine 21 is desired.

Thus, with reference to FIGS. 2 and 3, the inlet 23 for receiving water from the washing machine 21 is hence fitted in the water supply 28 of the washing machine such that water can flush the inside of the receptacle 20. Further, the outlet 25 of the receptacle 20 is fitted in the treatment agent inlet 29 of the washing machine 21 for transporting water-diluted treatment agent into the machine via the rubber hose 26. In an embodiment of the present invention, the water-receiving inlet 23 and the outlet 25 is arranged to engage with the water supply 28 and the treatment agent inlet 29, respectively, for retaining the receptacle in mounted engagement with the machine.

Figure 4:
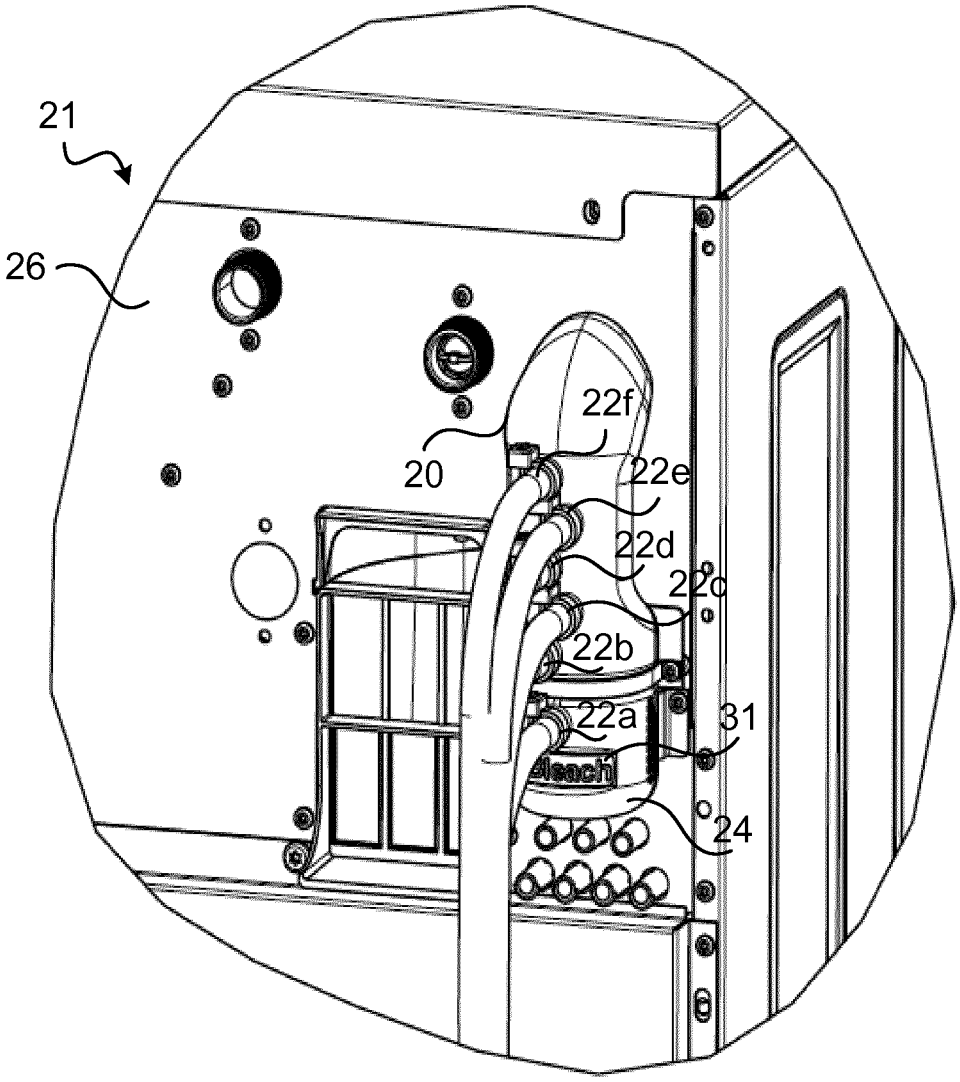
FIG. 4 illustrates a receptacle according to embodiments of the present invention being removably mounted to the rear side of a washing machine.

FIG. 4 illustrates a receptacle 20 according to embodiments of the present invention being removably mounted to the rear side 27 of the washing machine as has been discussed hereinabove. FIG. 4 shows a plurality of inlets 22*a-f* via which treatment agents can be supplied to the receptacle 20. Further illustrated in FIG. 4 is the embodiment of the invention where a visual indicator 31 indicating the treatment agent inlet 22*a* being located closest to the vessel 24 of the receptacle 20; in this particular example, the text "bleach" is printed on the receptacle in connection to this particular inlet for notifying an operator where the bleach is most appropriately supplied to the receptacle 20.

As has been illustrated throughout FIGS. 2-4, the inlet(s) 22*a*(*-f*) for receiving the treatment agent at the receptacle 20 is according to embodiments of the present invention arranged on an opposite side of the receptacle with respect to the water-receiving inlet 23 and the outlet 25 for providing diluted treatment to the washing machine. This is advantageous since water is supplied from one side while treatment agent is supplied from the opposite side, having the effect that the supply of treatment agent and the supply of water is kept separate. As compared to solutions in the art, changes can be made to the supplied treatment agent(s) without having to take into account water supplying means. As further has been illustrated, the receptacle 20 can be removably mounted in a swift and straightforward "plug and play" manner.

Figure 5:
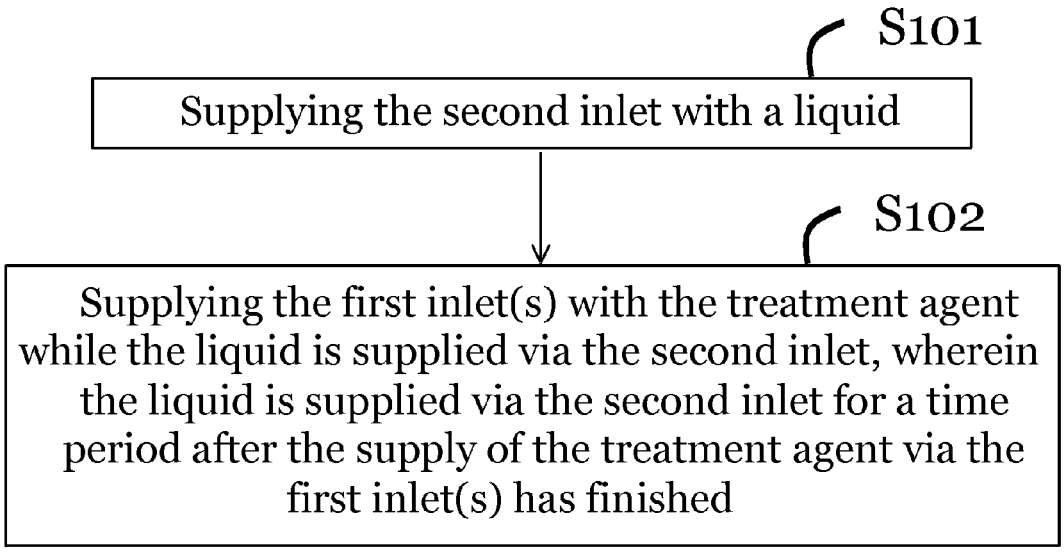
FIG. 5 shows a flowchart illustrating a method of supplying the receptacle according to any one of previously discussed embodiments with treatment agent and liquid.

FIG. 5 shows a flowchart illustrating a method of supplying the receptacle according to any one of previously discussed embodiments with treatment agent and liquid in the form of water. Reference is further made to FIG. 2. In a first step S101, the second inlet 23 is supplied with the water. In a second step S102, one or more of the treatment agent inlets 22*a-f* are supplied with the treatment agent while the water is still supplied to the second inlet 23. The water is supplied via the second inlet 23 for a certain time period after the supply of the treatment agent via the first inlets 22*a-f* has finished such that amount of treatment agent in the mixture in the vessel 24 is below a certain value. That is, the amount of treatment agent in the mixture in the vessel 24 should be sufficiently low such that no damage is created to the interior of the washing machine 21 should the mixture overflow into the first outlet 25 when the vessel is filled.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. Receptacle (20) for supply of a treatment agent to a machine (21) for washing and/or dishing and/or rinsing goods, which receptacle comprises:

at least a first inlet (22*a*) for receiving the treatment agent;

at least a second inlet (23) for receiving a liquid;

a vessel (24) located at a bottom section of the receptacle, said vessel being arranged to receive the treatment agent and the liquid supplied to the receptacle; and at least a first outlet (25) for supplying the machine with a mixture of the treatment agent and the liquid, said first outlet being in fluid connection with the vessel such that the mixture overflows into the first outlet when the vessel is filled, wherein the receptacle (20) is removably mounted to the machine (21) in a "plug and play" manner.

2. The receptacle (20) of claim 1, wherein said at least a first inlet (22*a*) further comprises a plurality of inlets (22*a-f*) for supplying treatment agents, wherein different types of treatment agents can be supplied via a respective one of the plurality of inlets.

3. The receptacle (20) of claim 1, wherein the treatment agent is at least one of a group of treatment agents comprising detergent, softener, bleach and starch.

4. The receptacle (20) of claim 1, said at least a second inlet (23) for supplying liquid being arranged at a top section of the receptacle.

5. The receptacle (20) of claim 1, said at least a second inlet (23) and said at least a first outlet (25) being arranged to engage with a liquid supply (28) and a treatment agent inlet (29) for the machine (21), respectively, for retaining the receptacle in engagement with the machine.

6. The receptacle (20) of claim 1, said at least a first inlet (22*a*) being arranged on an opposite side of the receptacle with respect to said at least a second inlet (23) and said at least a first outlet (25).

7. The receptacle (20) of claim 1, further being of a chemicals-resistant material.

8. The receptacle (20) of claim 2, wherein said at least a first inlet (22*a*) comprising a plurality of inlets (22*a-f*) is arranged such that an inlet supplying bleach to the receptacle is located closest to the vessel (24) of the plurality of inlets.

9. The receptacle (20) of claim 8, further being arranged with a visual indicator (31) indicating which one (22*a*) of said plurality of inlets (22*a-f*) is intended for supply of bleach.

10. The receptacle (20) of claim 1, further being arranged to be removably mountable to a rear side (27) of the machine (21).

11. The receptacle (20) of claim 1, wherein the first inlet (22*a*) is located closest to the vessel (24).

12. The receptacle (20) of claim 1, wherein the first inlet (22*a*) is located closer to the vessel (24) than the second inlet (23).

13. The receptacle (20) of claim 1, wherein the first inlet (22*a*) is located below a top portion of the first outlet (25).

14. The receptacle (20) of claim 1, further comprising a snap-in mechanism for removably attaching the receptacle (20) to the machine (21).

15. The receptacle (20) of claim 1, further comprising fasteners for removably attaching the receptacle (20) to the machine (21).

16. A dishwasher comprising a receptacle (20) according to claim 1.

17. A washing machine comprising a receptacle (20) according to claim 1.

18. A method of supplying the receptacle according to claim 1 with treatment agent and a liquid, the method comprising the steps of:

supplying (S101) the at least a second inlet (23) with the liquid; and supplying (S102) the at least a first inlet (22*a*) with the treatment agent while the liquid is supplied via the at least a second inlet (23), wherein the liquid is supplied via the at least a second inlet (23) for a time period after the supply of the treatment agent via the at least a first inlet (22*a*) has finished such that amount of treatment agent in the mixture in the vessel (24) is below a certain threshold value.

19. A method of supplying a receptacle for washing and/or dishing and/or rinsing goods with a treatment agent and a liquid, said receptacle comprising at least a first inlet (22*a*) for receiving the treatment agent, at least a second inlet (23) for receiving a liquid, a vessel (24) located at a bottom section of the receptacle, said vessel being arranged to receive the treatment agent and the liquid supplied to the receptacle, and at least a first outlet (25) for supplying the machine with a mixture of the treatment agent and the liquid, said first outlet being in fluid connection with the vessel such that the mixture overflows into the first outlet when the vessel is filled, wherein the receptacle (20) is removably mounted to the machine (21) in a "plug and play" manner, the method comprising the steps of:

supplying (S101) the at least a second inlet (23) with the liquid; and supplying (S102) the at least a first inlet (22*a*) with the treatment agent while the liquid is supplied via the at least a second inlet (23), wherein the liquid is supplied via the at least a second inlet (23) for a time period after the supply of the treatment agent via the at least a first inlet (22*a*) has finished such that amount of treatment agent in the mixture in the vessel (24) is below a certain threshold value.

20. Receptacle (20) for supply of a treatment agent to a machine (21) for washing and/or dishing and/or rinsing goods, said receptacle comprising:

at least a first inlet (22*a*) for receiving the treatment agent;

at least a second inlet (23) for receiving a liquid;

a vessel (24) located at a bottom section of the receptacle, said vessel being arranged to receive the treatment agent and the liquid supplied to the receptacle; and at least a first outlet (25) for supplying the machine with a mixture of the treatment agent and the liquid, said first outlet being in fluid connection with the vessel such that the mixture overflows into the first outlet when the vessel is filled, wherein the receptacle (20) is an add-on to the machine (21), and wherein the first inlet (22*a*) is located closer to the vessel (24) than the second inlet (23).

* * * * *